US007360867B2

(12) United States Patent
Nomori et al.

(10) Patent No.: US 7,360,867 B2
(45) Date of Patent: Apr. 22, 2008

(54) ADHESIVE AGENT AND INKJET HEAD AND MANUFACTURING METHOD THEREOF

(75) Inventors: Hiroyuki Nomori, Nishitokyo (JP); Tomomi Yoshizawa, Hino (JP); Tadashi Hirano, Hino (JP); Takeshi Ito, Hino (JP); Hajime Tanisho, Higashiosaka (JP)

(73) Assignees: Konica Minolta Holdings, Inc., Tokyo (JP); Hanna Chemical Industry Co., Ltd., Osaka (JP)

( * ) Notice: Subject to any disclaimer, the term of this patent is extended or adjusted under 35 U.S.C. 154(b) by 210 days.

(21) Appl. No.: 11/384,090

(22) Filed: Mar. 17, 2006

(65) Prior Publication Data

US 2006/0209126 A1 Sep. 21, 2006

(30) Foreign Application Priority Data

Mar. 18, 2005 (JP) ..... 2005-079528
Mar. 18, 2005 (JP) ..... 2005-079563
Dec. 19, 2005 (JP) ..... 2005-364969

(51) Int. Cl.
*B41J 2/15* (2006.01)

(52) U.S. Cl. ..... 347/40; 347/65

(58) Field of Classification Search ..... 347/40, 347/43, 12, 64, 65
See application file for complete search history.

(56) References Cited

U.S. PATENT DOCUMENTS 4,377,433 A * 3/1983 Merz et al. ..... 156/326
4,652,492 A * 3/1987 Seiner et al. ..... 428/414
2003/0047279 A1* 3/2003 Ramalingam ..... 156/330

* cited by examiner

*Primary Examiner*—Lamson Nguyen
(74) *Attorney, Agent, or Firm*—Frishauf, Holtz, Goodman & Chick, P.C.

(57) ABSTRACT

Disclosed is an adhesive agent which is curable and has flexibility at low temperature, and further has resistant to solvent type ink. The adhesive agent includes a base and an activator, wherein the base includes at least any one of: bisphenol F epoxy compound; bisphenol F epoxy compound mixed with an epoxy compound having three or more epoxy groups; and bisphenol A epoxy compound mixed with an epoxy compound having three or more epoxy groups, wherein the activator includes: 100 parts by mass of polyamide composed of a condensation reaction product of C36 unsaturated fatty acid dimer and polyamine; and 5 to 200 parts by mass of alicyclic polyamine, and wherein the base is mixed with the activator with a ratio of 10 to 200 parts by mass of the activator with respect to 100 parts by mass of the base.

6 Claims, 5 Drawing Sheets

ADHESIVE AGENT AND INKJET HEAD AND MANUFACTURING METHOD THEREOF

BACKGROUND OF THE INVENTION

1. Field of the Invention

The present invention relates to an adhesive agent in which epoxy compound is mixed with an activator, an inkjet head in which members are adhered to one another by the adhesive agent, and the manufacturing method thereof.

2. Description of Related Art

"Screen printing technique", which forms a desired pattern on a mesh screen to print ink running through the pattern onto a recording medium, has been widely used for the manufacturing of a liquid crystal color filter, the coating of a liquid crystal orientation film, and the fabrication of various precision electronic components such as organic electroluminescence devices.

However, the screen printing technique is inconvenient because an image cannot be printed easily with low cost. This is due to the fact that a screen must be designed and formed before printing is performed, or a new screen must be designed and formed in every time the pattern is changed. To solve this, the inkjet technique begins to be applied as a substitute technique for the screen printing technique by which an image or the like can be printed easily with low cost.

The inkjet technique is a technique by which an inkjet head for discharging droplets of ink is scanned above a recording medium to record an image or the like on the recording medium. When this inkjet technique is used as a substitute technique for the screen printing technique, since the screen printing techniques are mainly used on a resin-made recording medium as a recording medium (when a resin-made recording medium is used as a recording medium), "solvent-based ink" that easily penetrates through the resin is used to improve durability of the recording medium.

Here, the above inkjet head is structured such that members constituting the inkjet head are adhered to one another by adhesive agent. When solvent-based ink is used, the solvent-based ink may dissolve the adhesive agent. Thus, the adhesive agent is preferably epoxy-based adhesive agent cross-linked under high temperature. A technique applying this has been disclosed in JP 2003-266708A. Specifically, the technique described in JP 2003-266708A uses gradually increasing temperature for drying and curing of adhesive agent from a room temperature to 100° C., so that the crosslinking density is increased to enhance the resistance against the solvent-based ink (see paragraph Nos. 0034 to 0041).

An inkjet head is basically structured such that members constituting the head have different linear thermal expansion coefficients (thermal expansion coefficients) to one another. Thus, when adhesive agent is cured under high temperature, stress exerts between the cured adhesive agent and the members due to shrinkage difference between the members, because the members have different shrinkage factors when the temperature of the adhesive agent returns to a room temperature after the curing. This has a possibility that the members have cracks, distortions, or one member peels from another member.

According to some of the methods for suppressing the above stress, adhesive agent is cured in a low temperature close to the temperature of an environment in which the inkjet head is used (preferably room temperature) or the adhesive agent itself is provided with flexibility. However, adhesive agent which can be cured in a low temperature and which has flexibility has not sufficient resistance against solvent-based ink. Thus, no adhesive agent currently exists that can match the above conditions.

It is an objective of the present invention to provide adhesive agent which can be cured in a low temperature, which has flexibility, and which is resistant against solvent-based ink. It is another objective of the present invention to provide an inkjet head by which members of the inkjet head can be prevented from having cracks, distortions, peeling and the like, and the manufacturing method thereof.

According to a first aspect of the invention, an adhesive agent comprises a base and an activator, wherein the base comprises at least any one of: a first epoxy compound of bisphenol F epoxy compound; a second epoxy compound in which bisphenol F epoxy compound is mixed with an epoxy compound having three or more epoxy groups; and a third epoxy compound in which bisphenol A epoxy compound is mixed with an epoxy compound having three or more epoxy groups, wherein the activator comprises: polyamide composed of a condensation reaction product of C36 unsaturated fatty acid dimer and polyamine, and alicyclic polyamine, the activator containing 5 to 200 parts by mass of the alicyclic polyamine with respect to 100 parts by mass of the polyamide, and wherein the base is mixed with the activator with a ratio of 10 to 200 parts by mass of the activator with respect to 100 parts by mass of the base.

Preferably, the activator contains 10 to 150 parts by mass of the alicyclic polyamine with respect to 100 parts by mass of the polyamide, and more preferably, the activator contains 20 to 100 parts by mass of the alicyclic polyamine with respect to 100 parts by mass of the polyamide.

Preferably, the adhesive agent of the first aspect further comprises fine particles having mean particle size of 0.1 μm or less.

The first aspect can provide adhesive agent which can be cured in a low temperature, which has flexibility, and which is resistant to solvent-based ink (see the following embodiments 1 to 4).

According to a second aspect of the invention, an inkjet head comprises: a channel substrate having a channel of ink, an adherend member adhered to the channel substrate, and a second adherend member further adhered to the adherend member, wherein the channel substrate is adhered with the adherend member, or the adherend member is adhered with the second adherend member by an adhesive agent comprising a base and an activator, wherein the base comprises at least any one of: a first epoxy compound of bisphenol F epoxy compound; a second epoxy compound in which bisphenol F epoxy compound is mixed with an epoxy compound having three or more epoxy groups; and a third epoxy compound in which bisphenol A epoxy compound is mixed with an epoxy compound having three or more epoxy groups, wherein the activator comprises: polyamide containing a condensation reaction product of C36 unsaturated fatty acid dimer and polyamine, and alicyclic polyamine, the activator containing 5 to 200 parts by mass of the alicyclic polyamine with respect to 100 parts by mass of the polyamide, and wherein the base is mixed with the activator with a ratio of 10 to 200 parts by mass of the activator with respect to 100 parts by mass of the base.

Preferably, the activator contains 10 to 150 parts by mass of the alicyclic polyamine with respect to 100 parts by mass of the polyamide, and more preferably, the activator contains 20 to 100 parts by mass of the alicyclic polyamine with respect to 100 parts by mass of the polyamide.

Preferably, the adhesive agent of the second aspect further comprises fine particles having mean particle size of 0.1 μm or less.

Preferably, at least one of differences in linear thermal expansion coefficient between the channel substrate and the adherend member and between the adherend member and the second adherend member is greater than 12 ppm/K.

Preferably, the ink contains 3 mass % or more of solvent having 9.5 to 15.0 of a SP value and 2.0 to 5.0 of a dipole moment to whole solvent weight.

The second aspect uses the above adhesive agent to adhere a channel substrate with an adherend member or to adhere the adherend member with a second adherend member. Thus, stress exerting between the cured adhesive agent and a channel substrate, the adherend member, or the second adherend member can be reduced. Consequently, this can prevent the channel substrate, the adherend member, or the second adherend member from having cracks or distortions, or can prevent the adherend member from peeling off the channel substrate, or can prevent the second adherend member from peeling off the adherend member.

According to a third aspect of the invention, a manufacturing method of an inkjet head, the inkjet head comprising a channel substrate with a channel of ink, an adherend member adhered to the channel substrate, and a second adherend member further adhered to the adherend member, comprises the steps of: applying an adhesive agent comprising a base and an activator at least one of between the channel substrate and the adherend member, and between the adherend member and the second adherend member; and curing the adhesive agent by applying heat of 60° C. or less to the adhesive agent, so that the channel substrate is adhered with the adherend member, or the adherend member is adhered with the second adherend member, wherein the base comprises at least any one of: a first epoxy compound of bisphenol F epoxy compound; a second epoxy compound in which bisphenol F epoxy compound is mixed with an epoxy compound having three or more epoxy groups; and a third epoxy compound in which bisphenol A epoxy compound is mixed with an epoxy compound having three or more epoxy groups, wherein the activator comprises: polyamide containing a condensation reaction product of C36 unsaturated fatty acid dimer and polyamine, and alicyclic polyamine, the activator containing 5 to 200 parts by mass of the alicyclic polyamine with respect to 100 parts by mass of the polyamide, and wherein the base is mixed with the activator with a ratio of 10 to 200 parts by mass of the activator with respect to 100 parts by mass of the base.

Preferably the base comprises the second epoxy compound.

Preferably, the activator contains 10 to 150 parts by mass of the alicyclic polyamine with respect to 100 parts by mass of the polyamide, and more preferably, the activator contains 20 to 100 parts by mass of the alicyclic polyamine with respect to 100 parts by mass of the polyamide.

Preferably, the adhesive agent further comprises fine particles having mean particle size of 0.1 μm or less.

Preferably, the adhesive agent is cured by applying heat of 40° C. or less to the adhesive agent.

The third aspect cures the above adhesive agent by applying heat of 60° C. or less to the adhesive agent. Since the adhesive agent has a small temperature difference when the temperature of the cured adhesive agent decreases from the curing temperature to a room temperature, the stress exerting between the adhesive agent and the channel substrate, the adherend member, or the second adherend member is alleviated. As a result, the channel substrate, the adherend member or the second adherend member can be prevented from having cracks, the channel substrate, the adherend member, or the second adherend member can be prevented from having distortions, the adherend member can be prevented from peeing off the channel substrate, or the second adherend member can be prevented from peeling off the adherend member.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein.

DETAILED DESCRIPTION OF THE INVENTION

Hereinafter, the best mode for carrying out the present invention will be described with reference to the drawings. Although embodiments described hereinafter have various limitations that are technically preferable for carrying out the present invention, the scope of the invention is not limited to the following embodiments and illustrated examples.

Figure 1:
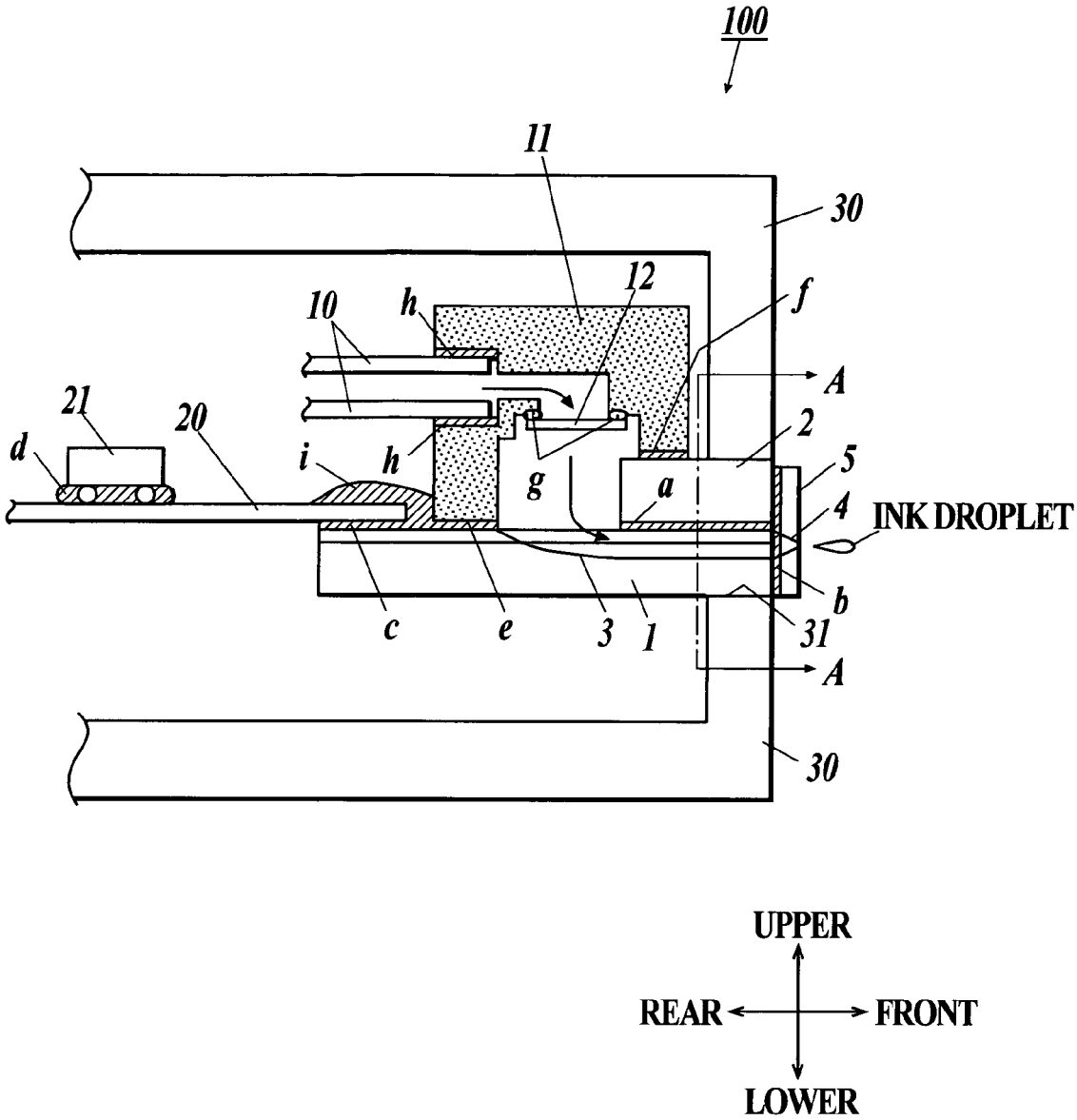
FIG. 1 is a cross-sectional side view illustrating the outline of the structure of the inkjet head 100.

FIG. 1 is a cross-sectional side view illustrating the outline of the structure of an inkjet head 100 according to the present invention.

As shown in FIG. 1, the inkjet head 100 has a channel substrate 1 in which an ink flow path (channel 3) is formed. A cover plate 2 is adhered on the top at the front side of the channel substrate 1, via an adhered section a. The cover plate 2 includes a material such as glass, ceramics, metal, or resin.

On the front end face of the channel substrate 1 and the cover plate 2, a nozzle plate 5, which has a jetting opening 4 for discharging ink in a droplet form, is adhered via an adhered section b. The channel substrate 1 includes the channel 3 (a groove) extending from the center part to the front end section. The channel 3 communicates with the jetting opening 4 of the nozzle plate 5. The nozzle plate 5 is made of resin such as polyimide.

Figure 2:
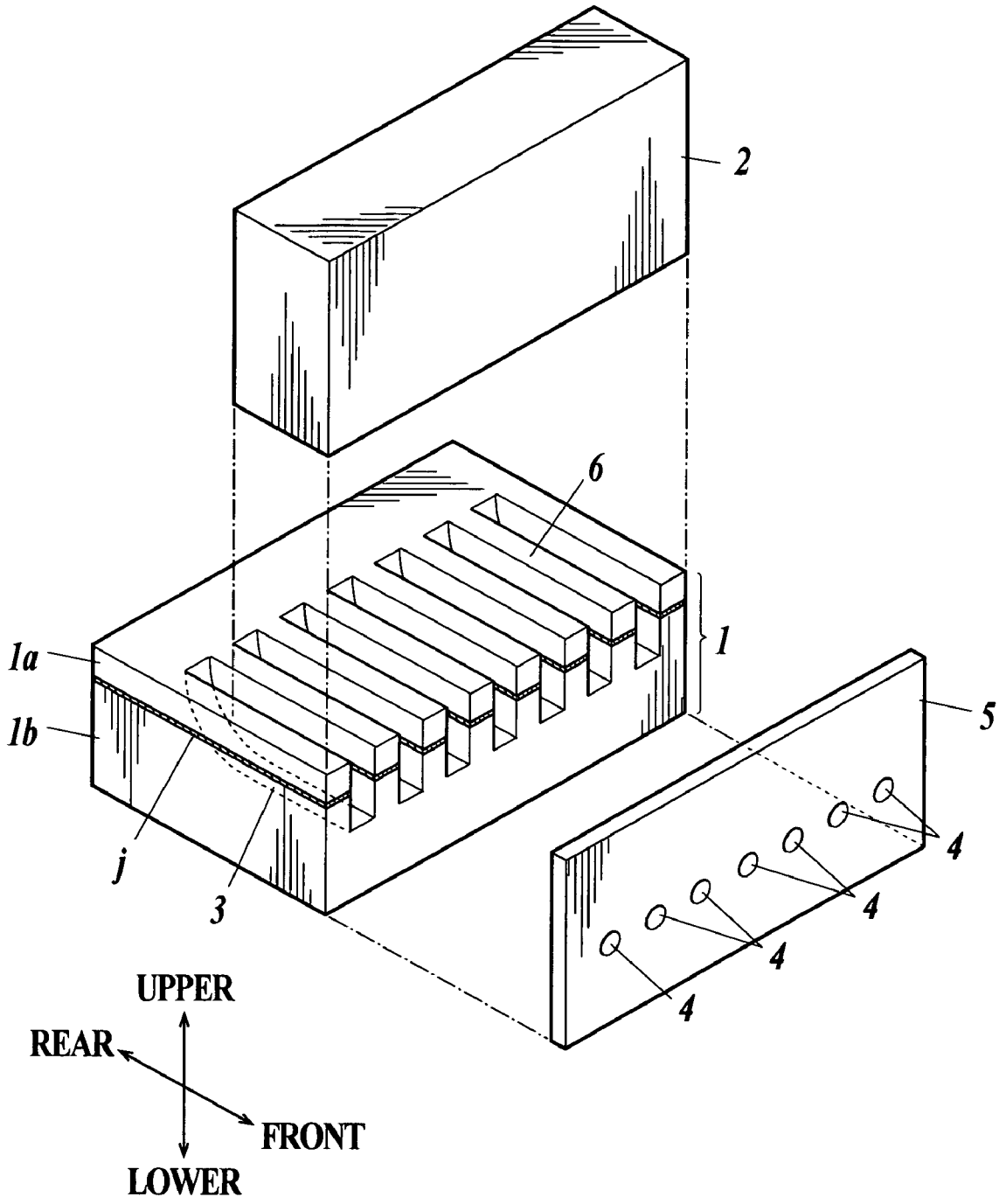
FIG. 2 is an exploded perspective view illustrating the structure of the main part of the channel substrate 1, cover plate 2, and nozzle plate 5.

FIG. 2 is an exploded perspective view illustrating the structure of the main part of the channel substrate 1, cover plate 2, and nozzle plate 5.

As shown in FIG. 2, the channel substrate 1 is structured such that two substrates 1*a* and 1*b* are adhered to each other via an adhered section j. The respective substrates 1*a* and 1*b* are made of piezoelectric material such as lead zirconate titanate (PZT) and are polarized in the direction of the thickness so that they polarize in opposite directions. The channel substrate 1 includes a plurality of channels 3, 3, . . . with equal gaps therebetween and the respective channels 3 have partition walls 6 therebetween. In other words, the channel substrate 1 includes the channels 3 and the partition walls 6 provided alternately.

Each of the channels 3 is a groove that is notched from the center part to the front end section of the channel substrate 1, and in the direction of the thickness of the channel substrate 1, the portion is cut from the substrate 1*a* to the middle section of the substrate 1*b*. In particular, the rear part of each of the channels 3 is gradually inclined from the top part of the substrate 1*a* to the middle section of the substrate 1*b* in a direction from the rear side to the front side so that ink smoothly flows through the upper part of the substrate 1*a* into inside of the channel 3.

In the channel substrate 1 having the structure as described above, the cover plate 2 is adhered to the upper part of the substrate 1*a* so as to cover the upper part of the respective channels 3. The front end face of the channel substrate 1 is adhered with the nozzle plate 5 so that the respective channels 3 communicate with the jetting openings 4.

Figure 3:
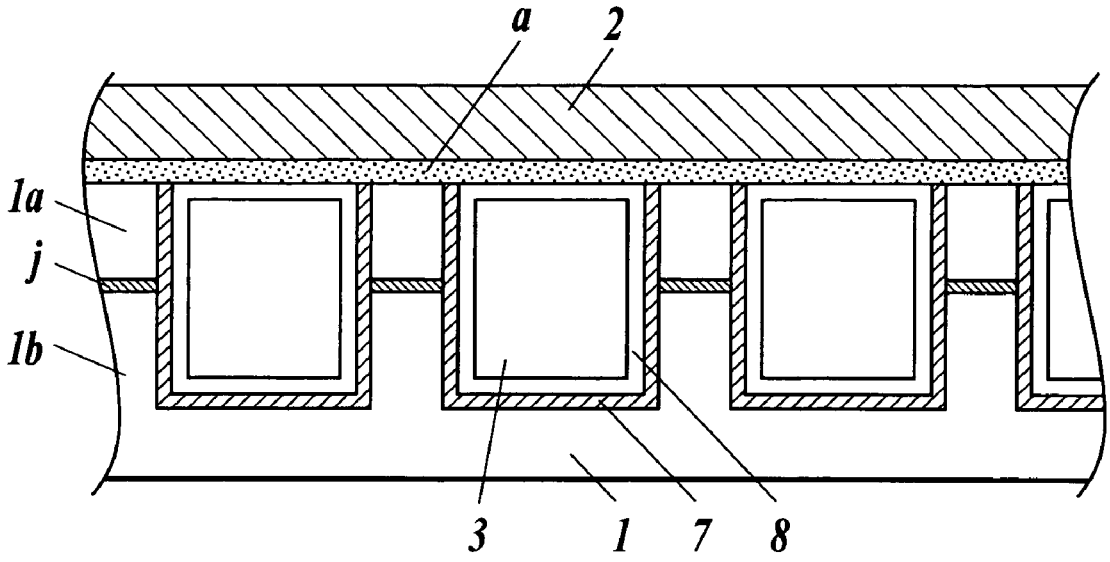
FIG. 3 is a cross-sectional view taken along the line A-A of FIG. 1.

FIG. 3 is a cross-sectional view taken along a line A-A of FIG. 1.

As shown in FIG. 3, each channel 3 has an inner wall having a metal electrode layer 7 such as aluminum or the like that is formed to have a U-shape. The inner wall of each electrode layer 7 and a part of the lower part of the adhered section a have a protection layer 8 formed in a rectangular shape. The respective protection layers 8 protect the electrode layers 7 and are composed of insulating poly-p-xylylene.

In the inkjet head 100, the substrates 1*a* and 1*b* are polarized in opposite directions to each other as descried above. This causes, when the respective electrode layers 7 are applied with voltage in the status shown in FIG. 4A, the respective partition walls 6 deform to have a "<"-like shape (or ">"-like shape) about the adhered section j adhered with the substrates 1*a* and 1*b* as shown in FIG. 4B (shearing deformation). In this case, when inner volumes of the respective channels 3 change to fluctuate the pressure applied to ink and the pressure reaches a predetermined value, ink is discharged from the jetting opening 4. When the application of the voltage to the respective electrodes 7 as shown in FIG. 4B is cancelled on the other hand, the respective partition walls 6 return to the original states as shown in FIG. 4C.

As shown in FIG. 1, an ink tube 10 for supplying ink to the respective channels 3 is provided at the upper part of the channel substrate 1. One end of the ink tube 10 is connected to a tank (not shown) storing ink and the other end of the ink tube 10 is connected to a manifold 11. The manifold 11 operates as a joint for connecting the ink tube 10 with the channel substrate 1. The ink tube 10 is adhered to the manifold 11 via an adhered section h. The manifold 11 is adhered to the channel substrate 1 and the cover plate 2 via adhered sections e and f, respectively.

The manifold 11 includes a metal filter 12 having a net structure therein. The filter 12 removes alien substances from ink and is adhered to the manifold 11 via an adhered section g.

A flexible print cable (FPC) 20 is disposed at the rear part of the channel substrate 1. The FPC 20 is adhered to the channel substrate 1 via adhered sections c and i. In particular, the adhered section i operates as a part for adhering the FPC 20 to the channel substrate 1 for a reinforcement purpose that the FPC 20 is prevented from peeling from the channel substrate 1. Although the details are not illustrated, the FPC 20 is electrically connected with the electrode layer 7 formed in each of the channels 3.

The FPC 20 includes a driver integrated circuit (IC) 21 adhered via an adhered section d. The driver IC 21 operates as a voltage generating source for causing the shearing deformation on the respective partition walls 6 of the channel substrate 1, and generates voltage based on an image signal transferred via the FPC 20 to apply the voltage to the respective electrode layers 7 via the FPC 20.

In the inkjet head 100 having the structure as described above, the nozzle plate 5 protrudes and the other portions other than the nozzle plate 5 are substantially covered by a boxy housing 30. Specifically, the housing 30 includes an opening section 31 that is fitted with the channel substrate 1 and the front end section of the cover plate 2.

The inkjet head 100 is also structured such that members adhered via the respective adhered sections a to j have differences in the linear thermal expansion coefficient greater than 12 ppm/K (or only some of the members may have differences in the linear thermal expansion coefficient greater than 12 ppm/K). In the case of the channel substrate 1 and manifold 11 adhered via the adhered section e, for example, the difference in linear thermal expansion coefficient between the channel substrate 1 and the manifold 11 is greater than 12 ppm/K.

When the nozzle plate 5 is made of polyimide, the difference in linear thermal expansion coefficient between the nozzle plates and channel substrate 1 is great than 12 ppm/K. In this case, this embodiment prevents the jetting opening 4 of the nozzle plate 5 from being adhered to the channel 3 of the channel substrate 1 in a dislocated manner, or adhesive agent constituting the adhered section b from flowing into the jetting opening 4 to deteriorate the discharging performance of ink.

Here, the respective adhered sections a to i for adhering the members to one another are composed of the following "adhesive agent". This adhesive agent according to the present invention will be described in detail hereinafter.

The adhesive agent according to the present invention is a mixture of "(1) base" and "(2) activator" in which 100 parts by mass of base is mixed with 10 to 200 parts by mass of activator (100 parts by mass of base is preferably mixed with 20 to 100 parts by mass activator).

(1) Base

The base includes any one of "(1.1) the first epoxy compound", "(1.2) the second epoxy compound", or "(1.3) the third epoxy compound". The base may include any one of epoxy compounds of the first epoxy compound to the third epoxy compound. Alternatively, the base may include two or more epoxy compounds of the first epoxy compound to the third epoxy compound.

(1.1) First Epoxy Compound

The first epoxy compound is "bisphenol F epoxy compound". Specific examples of bisphenol F epoxy compound include, for example, EPIKOTE 806,807 (made by Japan Epoxy compounds) and RE303S-L (made by NIPPON KAYAKU CO., LTD.).

(1.2) Second Epoxy Compound

Mixing "(1.2.1) bisphenol F epoxy compound "with" (1.2.2) epoxy compound having three or more epoxy groups" provides the second epoxy compound.

(1.2.1) Bisphenol F Epoxy Compound

Bisphenol F epoxy compound is the same as the one constituting the (1.1) first epoxy compound above.

(1.2.2) Epoxy Compound Having Three or More Epoxy Groups

Epoxy compound having three or more epoxy groups may include triglycidyl-p-aminophenol (TGAP), tetraglycidyl-diaminodiphenylmethane (TGDADPM), triglycidylisocyanurate, triglycidylurazole, triglycidylaminocresol, tetraglycidyl-1,3-diaminomethylcyclohexane, and glycerol triglycidyl ether.

Furthermore, epoxy compound having three or more epoxy groups also may be "phenol novolac type epoxy compound" or "cresol novolac type epoxy compound".

Specific examples of the phenol novolac type epoxy compound may include EPPN 201 and 202 (made by NIPPON KAYAKU CO., LTD.), EPIKOTE 154 (made by Japan Epoxy compounds Co., Ltd.), and DEN-438 (made by The Dow Chemical Company).

Specific examples of the cresol novolac-type epoxy compound may include EOCN 102, 103S, 104S, 1020, 1025, 1027 (made by NIPPON KAYAKU CO., LTD.) and EPIKOTE 180S (made by Japan Epoxy compounds Co., Ltd.).

Of these epoxy compounds having three or more epoxy groups include triglycidyl-p-aminophenol (TGAP) is preferable from the viewpoint of solvent resistance.

(1.3) Third Epoxy Compound

Mixing "(1.3.1) bisphenol A epoxy compound "with" (1.3.2) epoxy compound having three or more epoxy groups" provides the third epoxy compound.

(1.3.1) Bisphenol A Epoxy Compound

Specific examples of bisphenol A epoxy compound include EPIKOTE 828 (made by Japan Epoxy compounds Co., Ltd.).

(1.3.2) Epoxy Compound Having Three or More Epoxy Groups

Epoxy compound having three or more epoxy groups is the same as the ones of the (1.2.2) epoxy compound.

(2) Activator

Activator includes "(2.1) polyamide" and "(2.2) alicyclic polyamine," and includes 5 to 200 parts by mass of alicyclic polyamine with respect to 100 parts by mass of polyamide, (preferably includes 10 to 150 parts by mass of alicyclic polyamine with respect to 100 parts by mass of polyamide), and more preferably includes 20 to 100 parts by mass of alicyclic polyamine with respect to 100 parts by mass of polyamide.

The reason why activator includes 5 to 200 parts by mass of alicyclic polyamine with respect to 100 parts by mass of polyamide is that the content of alicyclic polyamine less than 5 parts by mass prevents adhesive agent from curing, and the content of alicyclic polyamine greater than 200 parts by mass causes adhesive agent itself (the respective adhered sections a to j) to be brittle, which may cause an inconvenience such as breakage of the inkjet head 100 with temperature fluctuation.

The reason why activator preferably includes 10 to 150 of parts by mass of alicyclic polyamine with respect to 100 parts by mass of polyamide is that the content of alicyclic polyamine ranging from 10 to 150 parts by mass improves the resistance of cured adhesive agent against solvent-based ink.

The reason why activator more preferably includes 20 to 100 parts by mass of alicyclic polyamine with respect to 100 parts by mass of polyamide is that the content of alicyclic polyamine ranging from 20 to 100 parts by mass further improves the resistance of cured adhesive agent agaist solvent-based ink and prevents the adhesive agent from dissolving into ink used in the inkjet head 100, preventing components in the adhesive agent from dissolving into ink to cause inconveniences such as the components adhered about the jetting opening 4, which causes unequal discharging directions of ink.

(2.1) Polyamide

Polyamide may be a condensation reaction product of C36 unsaturated fatty acid dimer and polyamine. Specific examples of polyamide include the condensation reaction product of dimer acid, which is the dimer of linoleic acid and ethylenediamine.

(2.2) Alicyclic Polyamine

Specific examples of alicyclic polyamine include methanediamine, isophoronediamine, N-aminoethylpiperazine, diaminodicyclohexylmethane, bis(4-amino-3-methylcyclohexyl)methane, 1,3-bis(aminomethyl)cyclohexane, 2,4-di(4-aminocyclohexylmethyl)aniline.

The adhesive agent also may be added with fine particles having mean particle size of equal to or less than 0.1 μm by 0.2 to 10 mass %. In this case, the respective adhered sections a to j can improve in retention viscosity (adhesion). The fine particles may be silica, alumina, or the like, and especially AEROSIL R202 made by NIPPON AEROSIL CO., LTD. is preferable.

Further, "ink" discharged from the inkjet head 100 is composed of a color material such as a dye or pigment and solvent (disolving agent) for dissolving the color materials. The type of the solvent is not limited. However, the ink preferably includes solvent having 9.5 to 15.0 of solubility parameter (SP) value ($(cal/cm^3)^{1/2}$) and 2.0 to 5.0 of dipole moment is included by 3 mass % to whole solvent because of an improved fixation of a printed image. This embodiment is characterized in that the durability of adhesive does not deteriorate. Specific examples of the solvent include: N,N-dimethylformamide (SP value is 12.1, dipole moment 3.86), N-methyl-2-pyrrolidinone (SP value is 11.3, dipole moment 4.09), ethyl lactate (SP value is 10.0, dipole moment 2.14), cyclohexanone (SP value is 9.9, dipole moment 3.01), and 2-pyrrolidinone (SP value is 14.7, dipole moment 3.83).

It is noted that the dipole moments above are calculated by MOPAC AM1 and the SP values are calculated by Bicerano method. Details of "Bicerano method" are described in "Prediction of Polymer Properties" (Plastics Engineering, 65) written by Jozef Bicerano.

Next, the manufacturing method of "inkjet head 100" according to the present invention will be described.

First, the above adhesive agent is coated on two flat substrates 1*a* and 1*b* to adhere the respective substrates 1*a* and 1*b* to each other (to form the adhered section j). Then, the adhered section j is applied with heat of 60° C. or less (preferably 40° C. or less) to cure the adhered section j to adhere the respective substrates 1*a* and 1*b* to each other. After the respective substrates 1*a* and 1*b* are adhered, a dicing blade or the like is used for the channel substrate 1 to form a plurality of channels 3,3, . . . . Then, inner walls of the respective channels 3 are subjected to a well known vapor deposition process to form the electrode layers 7 on the interior wall of the respective channels 3.

Figure 5A:
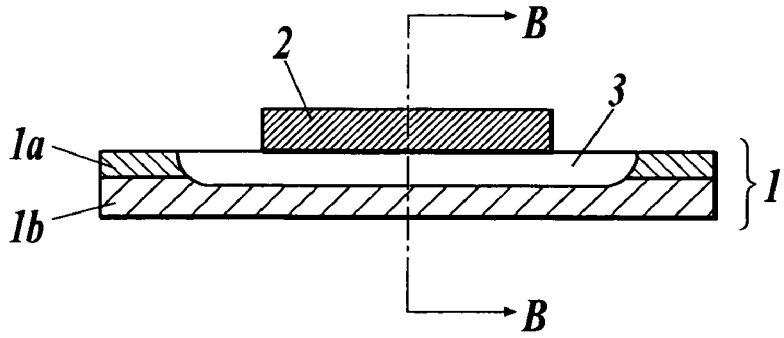
FIG. 5A is a diagram for explaining a part of steps of the manufacture method of the inkjet head 1.
Figure 5B:
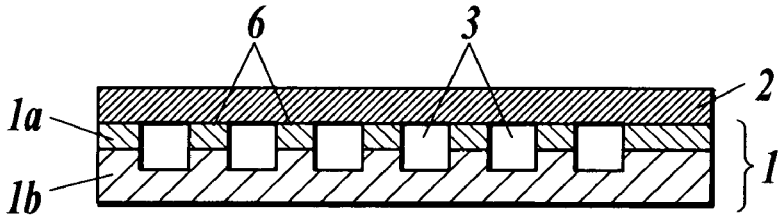
FIG. 5B is a diagram for explaining a part of steps of the manufacture method of the inkjet head 1.
Figure 5C:
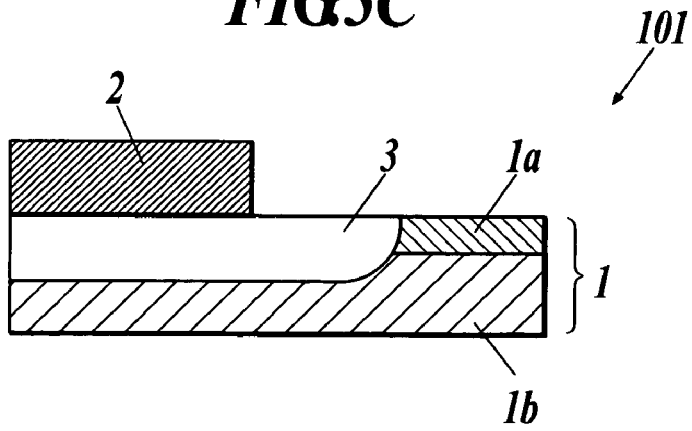
FIG. 5C is a diagram for explaining a part of steps of the manufacture method of the inkjet head 1.

After the electrode layers 7 are formed on the interior wall of the respective channels 3, on the top of the substrate 1*a* of the channel substrate 1, the above adhesive agent is coated to adhere the cover plate 2 (to form the adhered section a). Then, the adhered section a is applied with heat of 60° C. or less (preferably 40° C. or less) to cure the adhered section a. As a result, the top of the substrate 1*a* is adhered with the cover plate 2 as shown in FIGS. 5A and 5B. (FIG. 5B is a cross-sectional view taken along the line B-B of FIG. 5A. FIGS. 5A to 5C do not illustrate the respective adhered sections a and j and the electrode layers 7.)

After the cover plate 2 is adhered to the channel substrate 1, the inner wall of the electrode layer 7 is subjected to a poly-p-xylylene using by chemical vapor deposition (CVD) method to form the protection layers 8 at the interior of the respective channels 3. After the protection layer 8 is formed, the center part of both the channel substrate 1 and the cover plate 2 is cut (evenly-divided) along a direction orthogonal to the direction of the length of the respective channels 3 to manufacture two head chips 101 and 101, as shown in FIG. 5C. (FIG. 5C does not illustrate the electrode layer 7 and the protection layer 8.)

After the head chip 101 is manufactured, the respective end faces of the channel substrate 1 and the cover plate 2 are coated with the above adhesive agent. These end faces are adhered with the nozzle plate 5 so that the respective jetting openings 4 communicate with the channel 3 (the adhered section b is formed). Then, the adhered section b is applied with heat of 60° C. or less (preferably 40° C. or less) to cure the adhered section b. Then, the respective end faces of the channel substrate 1 and the cover plate 2 are adhered with the nozzle plate 5.

After the nozzle plate 5 is adhered, the adhesive agent is coated to members that constitute the inkjet head 100 and other than the above ones, such as manifold 11, FPC 20, housing 30. These members are adhered to predetermined positions of the head chip 101 (the adhered sections c to j are formed). Then, the respective adhered sections c to i are applied with heat of 60° C. or less (preferably 40° C. or less) to cure the respective adhered sections c to i, thereby adhering these members with the head chip 101. Through these processing steps, the inkjet head 100 according to the present invention can be manufactured.

Although this embodiment apply heat to each of the adhered sections a to j every time each of the adhered sections a to j is formed to cure each of the adhered sections a to j, all of the respective adhered sections a to j also may be formed (all of the members are adhered to one another) to subsequently apply heat to all of the adhered sections a to j so that all of the adhered sections a to j are cured simultaneously.

Next, the inkjet head 100 will be described with regards to the operations and effects thereof.

When ink is sent from an ink tank (not shown) through the ink tube 10 to flow into the manifold 11, alien substances in the ink is removed by the filter 12. The ink is stored in the manifold 11 and the respective channels 3 (see the arrow in FIG. 1).

When an image signal is transferred to a driver IC 21 via an FPC 20 in this state, the driver IC 21 generates, along with the relevant image signal, a driving voltage for causing the shearing deformation of the respective partition walls 6 of the channel substrate 1, and applies the driving voltage to the respective electrode layers 7 via the FPC 20.

Figure 4A:
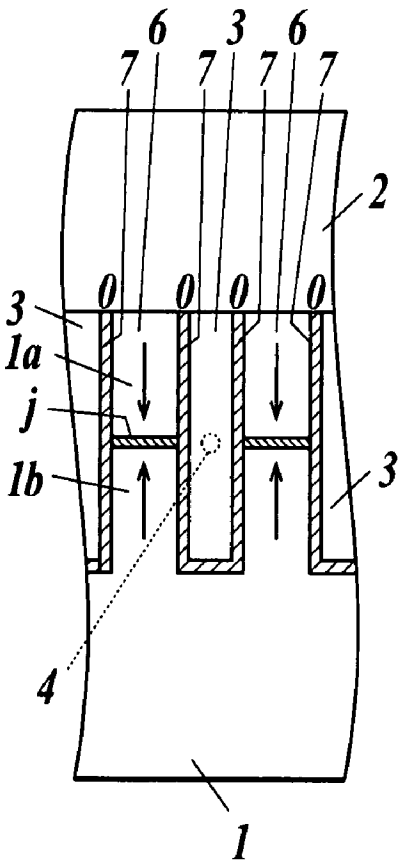
FIG. 4A shows the change of the state of the partition walls 6 when the respective electrode layers 7 are applied with voltage.
Figure 4B:
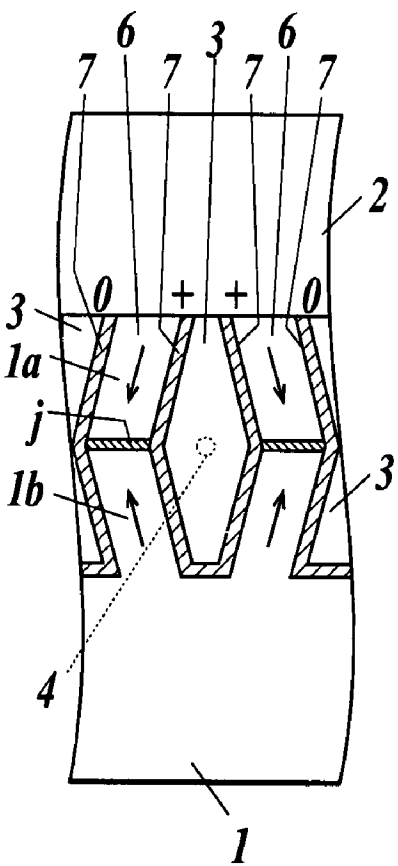
FIG. 4B shows the change of the state of the partition walls 6 when the respective electrode layers 7 are applied with voltage.
Figure 4C:
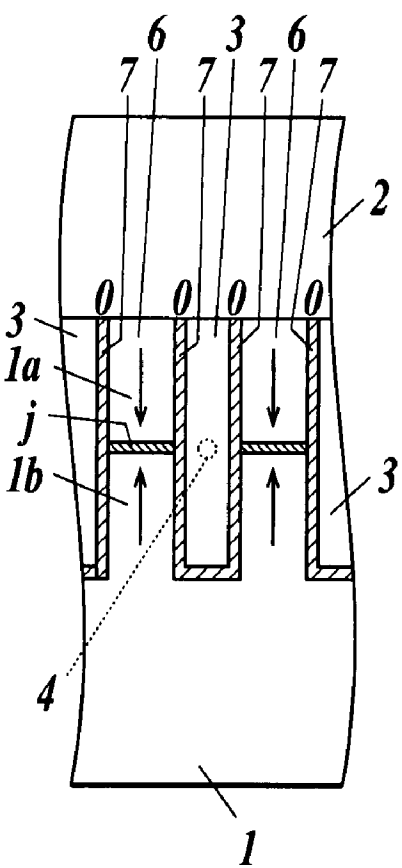
FIG. 4C shows the change of the state of the partition walls 6 when the respective electrode layers 7 are applied with voltage.

When the respective electrode layers 7 receive the driving voltage, the respective partition walls 6 exert shearing deformation to have a "<"-shape or ">"-shape about the adhered section j of the substrates 1*a* and 1*b* (the state shown in FIG. 4A is changed to the one shown in FIG. 4B). The inner volume of the respective channels 3 fluctuates the pressure applied to the ink. When the pressure reaches a predetermined value, the inkjet head 100 discharges the ink in a droplet form via the jetting opening 4.

In this embodiment, the respective adhered sections a to j are composed of the above adhesive agent, and cured by being applied with heat of 60° C. or less when the inkjet head 100 is manufactured. This alleviates the stress between the respective cured and adhered sections a to j and the members adhered by the adhered sections a to j (e.g., the stress between the adhered section a and the channel substrate 1 or the cover plate 2).

Specifically, the stress P generated between the adhesive agent and the adherend member adhered by the adhesive agent is calculated by a formula (A) as shown below.

$$P \approx E\Delta\alpha(t_2 - t_1) \quad \text{(A)}$$

In the formula (A), "E" represents an elastic modulus of the adhesive agent, "Δα" represents a difference in linear thermal expansion coefficient between the adhesive agent and an adherend member, "$t_2$" represents a curing temperature (temperature of heat applied to the adhesive agent), and "$t_1$" represents room temperature.

Suppose that the elastic modulus of the adhered section a is 3430 MPa, the linear thermal expansion coefficient of the channel substrate 1 $2\times10^{-6}$/° C., and the linear thermal expansion coefficient of the adhered section a $8\times10^{-5}$/° C., for example. When the adhered section a is cured by applying heat of "100° C." to the adhered section, the stress caused when the temperature of the adhered section a returns to room temperature (25° C.) is calculated as 20.07 MPa according to the above formula (A). Therefore, the stress of the level of 20 MPa is generated between the adhered section a and the channel substrate 1. In this state, deflection is caused in the channel substrate 1 and compression stress is caused inside the channel substrate 1. As a result, the channel substrate 1 is partially depolarized to cause fluctuated discharge of ink.

However, when the adhered section a is applied with heat of 60° C. to cure the adhered section a as in the case of this embodiment, the stress caused when the temperature of the adhered section a returns to room temperature (25° C.) is calculated as 9.3 MPa. Thus, the stress caused between the adhered section a and the channel substrate 1 is substantially reduced to the half of the above case. The stress caused between the adhered section a and the channel substrate 1 is alleviated.

As realized by the description above, this embodiment alleviates the stress between the respective cured and adhered sections a to j channel substrate 1, and an adherend member (such as, cover plate 2, nozzle plate 5, manifold 11) adhered to the channel substrate 1, or the second adherend member (such as, manifold 11, ink tube 10, filter 12) adhered to the relevant adherend member. As a result, the respective members constituting the inkjet head 1 can be prevented from having cracks or being distorted, or from peeling off another member.

When the manifold 11 is formed by thermoplastic resin in particular, the formation is performed easily. However, the manifold 11 has a high linear thermal expansion coefficient to cause a difference in the linear thermal expansion coefficient between the channel substrate 1 and the cover plate 2 to easily exceed 12 ppm/K. Furthermore, the manifold 11 has a large cross-sectional area, and thus receives high stress from the channel substrate 1 or the cover plate 2 (to put it the other way around, the channel substrate 1 or the cover plate 2 also receive high stress from the manifold 11). Thus, in this case, the channel substrate 1, the cover plate 2, and the manifold 11 tend to have cracks, distortions, or peelings, for example. However, in this embodiment these members are adhered to one another by the above adhesive agent, and thus effectively preventing the members from having cracks, distortions, peelings, for example.

Embodiment 1

(1.1) Preparation of Samples 1 to 7

A base was mixed with an activator and the resultant mixture was formed in droplets to be dropped onto a TEFLON sheet. The droplets each were 0.1 to 0.2 g. Thereafter, the respective dropped droplets were cured by maintaining in 25° C. for 10 hours to prepare tablets of the adhesive agent. These tablets were assumed as "samples 1 to 7". The compositions of the respective samples 1 to 7 (types of the base and activator) are as shown in Table 1.

(1.2) Measurement of Mass Increase Ratio of Samples 1 to 7

After the preparation of the samples 1 to 7, the masses of the respective samples 1 to 7 were measured. The respective samples 1 to 7 were immersed in solvents (butoxyethylacetate, xylene) and were kept in 60° C. for 7 days. After 7 days, the respective samples 1 to 7 were taken out of the solvent and rinsed with isopropyl alcohol from a washing bottle. After the rinsing, isopropyl alcohol on the respective samples 1 to 7 was removed and the masses of the respective samples 1 to 7 were measured again.

After the second measurement of the masses, the mass increase ratios of the respective samples 1 to 7 were calculated based on the following formula. The calculated results are shown in Table 1.

$$\text{Mass increase ratio}=(((\text{mass after immersion in solvent})-(\text{mass before immersion in solvent}))/(\text{mass before immersion in solvent}))\times 100$$

TABLE 1

| SAMPLE NO. | ADHESIVE AGENT BASE | ADHESIVE AGENT ACTIVATOR | SOLVENT BUTOXY ETHYLACETATE | SOLVENT XYLENE | REMARKS |
|---|---|---|---|---|---|
| 1 | EPIKOTE 806 (100) | — HC-100H (60) | 2 | 3 | INVENTIVE |
| 2 | EPIKOTE 806 (100) | — HC-120H (50) | 1.5 | 3 | INVENTIVE |
| 3 | EPIKOTE 806 (60) | EPIKOTE 154 (40) HC-100H (60) | 1.5 | 2 | INVENTIVE |
| 4 | EPIKOTE 806 (60) | EPIKOTE 154 (40) HC-120H (50) | 1 | 1 | INVENTIVE |
| 5 | EPIKOTE 806 (100) | — TRIETHYLENE TETRAMINE (9) | NO CURING | NO CURING | COMPARATIVE |
| 6 | EPIKOTE 828 (100) | — HC-100H (60) | 9 | 17 | COMPARATIVE |
| 7 | EPIKOTE 828 (100) | — MIXTURE OF TRIOXYAN-TRIMETYLENE MERCAPTAN (44) AND TRIBENZYLAMINE (1) | 33 | 21 | COMPARATIVE |

In the "base" of Table 1, "EPIKOTE 806" is bisphenol F epoxy compound (made by Japan Epoxy compounds Co., Ltd.), "EPIKOTE 828" is bisphenol A epoxy compound (made by Japan Epoxy compounds Co., Ltd.), and "EPIKOTE 154" is phenol novolac epoxy compound (made by Japan Epoxy compounds Co., Ltd).

In the "activator" of Table 1, "HC-100H" is the mixture of 100 parts by mass of polyamide and 55 parts by mass of diaminodicyclohexylmethane (made by HANNA KAGAKU CO., LTD.). "HC-120H" is the mixture of 100 parts by mass of polyamide, and 60 parts by mass of isophoronediamine and the adduct thereof (made by HANNA KAGAKU CO., LTD.). "Polyamide" of HC-100H and HC-120H is the condensation reaction product of the dimer acid which is the dimmer of linoleic acid with ethylenediamine.

In the "base" of Table 1, values in parentheses represent parts by mass of the respective epoxy compounds. In the "activator" of Table 1, values in parentheses represent parts by mass of the activator to base of 100 parts by mass. In the "mass increase ratio" of Table 1, the term "no curing" represents that, due to the adhesion of the surface of samples, the samples were not immersed in solvent.

(1.3) Conclusion

As shown in Table 1, the samples 1 to 4 show much lower weight changing ratios than those of the samples 5 to 7, demonstrating that the samples 1 to 4 are hard to dissolve into solvents. From the above, the adhesive agents having specific compositions like those of the samples 1 to 4 can be cured at low temperature equal to or lower than 60° C. and are resistant to the solvent.

Embodiment 2

(2.1) Preparation of Heads 1 to 7

Two PZT substrates of "the first PZT substrate (thickness of 150 μm, Curie temperature of 210° C., linear thermal expansion coefficient of 4 ppm/K) and "the second PZT substrate" (thickness of 700 μm, Curie temperature of 210° C., linear thermal expansion coefficient of 4 ppm/K) were provided. Then, these first and second PZT substrates were adhered to each other so that the polarization directions are opposite to each other. The first PZT substrate was adhere with the second PZT substrate by EPO-TEK 353ND (made by Rikei Corporation) as the adhesive agent. The adhesive agent was applied with heat of 80 to 100° C. to cure the adhesive agent.

After the adhesion of the first PZT substrate with the second PZT substrate, a channel (groove) having a depth of 300 μm and a width of 70 μm is formed from the first PZT substrate to the second PZT substrate. Then, the inner wall of the channel is vapor-deposited with aluminum to form an aluminum electrode inside the channel.

After the formation of the electrode layer, a cover plate (made of aluminum nitride having a thickness of 700 μm and a linear thermal expansion coefficient of 4 ppm/K) was adhered on the first PZT substrate by the adhesive agent (see FIGS. 5A and 5B). The cover plate was adhered with the first PZT substrate by EPO-TEK 353ND (made by Rikei Corporation) as the adhesive agent. The adhesive agent was applied with heat of 80 to 100° C. to cure the adhesive agent.

After the adhesion of the cover plate, the inner wall of the electrode layer was subjected to a poly-p-xylylene by the CVD method to form a protection layer in the channel. After the formation of the protection layer, the respective first and second PZT substrates and cover plate were cut in a direction orthogonal to the direction of the length of the channel, thereby manufacturing head chips (see FIG. 5C).

After the manufacture of the head chips, the head chips were adhered with a nozzle plate (provided with a jetting opening having a diameter of 30 μm in polyimide having a thickness 100 μm). The cover plate was adhered with the head chip (the first PZT substrate) by EPO-TEK 353ND (made by Rikei Corporation.) as the adhesive agent and the adhesive agent was applied with heat of 80 to 100° C. to cure the adhesive agent.

After the adhesion of the nozzle plate, the head chip was adhered with other members such as manifold (made of polyamide and having a linear thermal expansion coefficient of 50 ppm/K) by the adhesive agent, thereby manufacturing an inkjet head. In this embodiment 2, the adhesion of the manifold (the adhesion of the manifold with the cover plate and the adhesion of the manifold with the first PZT substrate) was performed by using seven types of adhesive agents as shown in Table 2 below. These respective adhesive agents were applied with heat of 30° C. for 6 hours to cure the respective adhesive agents. Then, total of seven types of inkjet heads in accordance with these types of adhesive agents were manufactured. These inkjet heads were referred to as "heads 1 to 7".

(2.2) Evaluation of the Respective Heads 1 to 7

(2.2.1) Discharging Test

Mixture of 90 parts by mass of butoxyethylacetate (SP value is 8.9, dipole moment 3.10) and 10 parts by mass of 2-pyrrolidinone (SP value is 14.7, dipole moment 3.83) was prepared as a substitute for inks. The mixture was filled into the respective heads 1 to 7 and the respective heads 1 to 7 filled with the mixture were maintained in 60° C. for 1 to 5 weeks. Thereafter, every time a predetermined period has passed, the respective heads 1 to 7 were caused to discharge the mixture to evaluate the discharging performance of the respective heads 1 to 7 (to investigate when ink leakage was caused). Table 2 below shows the evaluation result (the longest numbers of the days during the time no ink leakage was caused in the above period).

(2.2.2) Heat Cycle Test

In the first heat cycle test, the respective heads 1 to 7 were subjected to a heat cycle environment having three cycles each of which consists of 25° C., (60° C., 1 hour), (25° C., 30 minutes), (0° C., 1 hour), and (25° C., 30 minutes) in this order. Then, the channels of the respective heads 1 to 7 were vacuumed to check whether the channels have air leakage.

Thereafter, the respective heads 1 to 7 were subjected the second heat cycle test in which the heads were subjected to a heat cycle environment having three cycles each of which consists of 25° C., (60° C., 1 hour), (25° C., 30 minutes), (−20° C., 1 hour), and (25° C., 30 minutes) in this order. Then, the channels of the respective heads 1 to 7 were vacuumed to check whether the channels have air leakage.

The test result is shown in Table 2 below. In the "heat cycle test" of Table 2, the following remarks, A, B, C and D, have the following meanings:

A: None of the first and second heat cycle tests showed air leakage.

B: The first heat cycle test showed no air leakage but the second heat cycle test showed air leakage.

C: The first heat cycle test showed some air leakage.

D: The first heat cycle test showed air leakage.

(2.2.3) Observation of Existence of Cracks

After the above heat cycle tests, whether the adhesive agent between the cover plate and manifold showed cracks was visually observed with the respective heads 1 to 7. The observation result is shown in Table 2 below. In the "cracks" of Table 2, the following remarks of A, B, and C, have the following meanings.

A: No cracks were found.

B: One or two crack(s) was/were found.

C: Three or more cracks were found.

TABLE 2

| HEAD | ADHESIVE AGENT | | EVALUATION | | | |
|---|---|---|---|---|---|---|
| | | | | HEAT CYCLE | | |
| NO. | BASE | ACTIVATOR | JETTING TEST | TEST | CRACK | REMARKS |
| 1 | EPIKOTE 806 — | HC-100H (60) | NO INK LEAKAGE AFTER 2 WEEKS | A | A | INVENTIVE |

TABLE 2-continued

| HEAD NO. | ADHESIVE AGENT BASE | | ACTIVATOR | EVALUATION JETTING TEST | HEAT CYCLE TEST | CRACK | REMARKS |
|---|---|---|---|---|---|---|---|
| | (100) | | | | | | |
| 2 | EPIKOTE 806 (100) | — | HC-120H (50) | NO INK LEAKAGE AFTER 3 WEEKS | A | A | INVENTIVE |
| 3 | EPIKOTE 806 (60) | EPIKOTE 154 (40) | HC-100H (60) | NO INK LEAKAGE AFTER 2 WEEKS | A | A | INVENTIVE |
| 4 | EPIKOTE 806 (60) | EPIKOTE 154 (40) | HC-120H (50) | NO INK LEAKAGE AFTER 3 WEEKS | A | A | INVENTIVE |
| 5 | EPIKOTE 806 (100) | — | TRIETHYLENE-TETRAMINE (9) | ADHESION WAS STILL LEFT AND LEAKAGE OCCURRED IN THE FIRST TEST. | D | — | COMPARATIVE |
| 6 | EPIKOTE 828 (100) | — | HC-100H (60) | INK LEAKAGE OCCURRED AFTER 1 WEEK | C | B | COMPARATIVE |
| 7 | EPIKOTE 828 (100) | — | MIXTURE OF TRIOXYAN-TRIMETYLENE MERCAPTAN (44) AND TRIBENZYLAMINE (1) | INK LEAKAGE OCCURRED AFTER 1 WEEK | C | A | COMPARATIVE |

In Table 2, items in the "base" and "activator" and values in the parentheses corresponds to those in Table 1 of the embodiment 1.

(2.3) Conclusion

As shown in Table 2, the heads 1 to 4 show preferable results compared to the case of the heads 5 to 7. In particular, the heads 1 to 4 showed no cracks, distortions, peelings, or the like in the manifold in the discharging test, heat cycle tests, and observation of the cracks showed that the adhesive agent has flexibility. Accordingly, the adhesive agents having specific compositions as used in the heads 1 to 4 have flexibility after being cured with heat equal to or lower than 60° C. It is also clear that these adhesive agents effectively function to prevent members from having cracks, distortions, peelings, or the like.

Embodiment 3

(3.1) Preparation of Samples 1 to 9

As in the section (1.1) of the embodiment 1, "samples 1 to 9" were prepared. The respective samples 1 to 9 have compositions (types of the base and activator) as shown in Table 3 below.

(3.2) Measurement of Mass Increase Ratio of Samples 1 to 9

As in the section (1.2) of the embodiment 1, mass increase ratios of the respective samples 1 to 9 were calculated. The calculation result is shown in Table 3 below.

TABLE 3

| SAMPLE NO. | ADHESIVE AGENT BASE | | | ACTIVATOR | SOLVENT BUTOXY ETHYLACETATE | XYLENE | REMARKS |
|---|---|---|---|---|---|---|---|
| 1 | EPIKOTE 806 (70) | TGAP (30) | — | HC-100H (80) | 1.5 | 2.5 | INVENTIVE |
| 2 | EPIKOTE 828 (70) | TGAP (30) | — | HC-100H (80) | 2.5 | 3.5 | INVENTIVE |
| 3 | EPIKOTE 806 (70) | TGAP (30) | — | HC-120H (80) | 1 | 2 | INVENTIVE |
| 4 | EPIKOTE 806 (50) | TGDADPM (50) | — | HC-100H (90) | 3 | 3 | INVENTIVE |
| 5 | EPIKOTE 806 (35) | TGAP (30) | EPIKOTE 154 (35) | HC-100H (80) | 1 | 1.5 | INVENTIVE |
| 6 | EPIKOTE 806 (70) | TGAP (30) | — | TRIETHYLENE-TETRAMINE (9) | NO CURING | NO CURING | COMPARATIVE |

TABLE 3-continued

| SAMPLE NO. | ADHESIVE AGENT BASE | | | ACTIVATOR | SOLVENT BUTOXY ETHYLACETATE | XYLENE | REMARKS |
|---|---|---|---|---|---|---|---|
| 7 | EPIKOTE 828 (100) | — | — | HC-100H (60) | 9 | 17 | COMPARATIVE |
| 8 | EPIKOTE 806 (70) | TGAP (30) | — | MIXTURE OF TRIOXYAN-TRIMETYLENE MERCAPTAN (44) AND TRIBENZYLAMINE (1) | 28 | 19 | COMPARATIVE |
| 9 | EPIKOTE 806 (70) | EPIKOTE 154 (30) | — | HC-120H (80) | 2.5 | 4.0 | INVENTIVE |

In the "base" and "activator" of Table 3, types and values in parentheses have the same meanings as those in Table 1 of the embodiment 1. However, in the "base" of Table 3, "TGAP" means triglycidyl-p-aminophenol and "TGDADPM" means tetraglycidyl diaminodiphenylmethane. The term "no curing" in the "mass increase ratio" in Table 3 also has the same meaning as that in Table 1 of embodiment 1.

(3.3) Conclusion

As can be seen from Table 3, the samples 1 to 5 and 9 show weight changing ratios that are much lower than those of the samples 6 to 8, and the samples 1 to 5 and 9 are hard to be dissolved in solvents. From the above, the adhesive agents having specific compositions like those of the samples 1 to 5 and 9 cure at a low temperature equal to or lower than 60° C., and are resistant to the solvents.

Embodiment 4

(4.1) Preparation of Heads 1 to 9

As in the section (2.1) of the embodiment, an inkjet head was prepared. In this embodiment 4, the adhesion of a manifold (the adhesion of the manifold with the cover plate, and the adhesion of a manifold with the first PZT substrate) was performed by eight types of adhesive agents shown in Table 4 below. These respective adhesive agents were applied with heat of 30° C. for 6 hours to cure the respective adhesive agents. Then, total of eight inkjet heads were manufactured in accordance with these adhesive agents. These inkjet heads were referred to as "heads 1 to 9".

(4.2) Evaluation of the Respective Heads 1 to 9

(4.2.1) Discharging Test

As in the section (2.2.1) of the embodiment 2, the discharging performances of the respective heads 1 to 9 were evaluated (when ink leakage was caused). Table 4 shows the evaluation result (the longest numbers of the days during the time no ink leakage was caused in the above period).

(4.2.2) Heat Cycle Test

As in the section (2.2.2) of the embodiment 2, the respective heads 1 to 9 were subjected to the heat cycle test. The test result is shown in Table 4 below. In the "heat cycle test" of Table 4, the following remarks, A, B, C and D, have the same meanings as those of Table 2 of the embodiment 2.

(4.2.3) Observation of Existence of Cracks

After the above heat cycle test, whether adhesive agent between the cover plate and manifold showed cracks was visually observed for the respective heads 1 to 9. The observation result is shown in Table 4 below. In the "cracks" section of Table 4, the remarks, A, B and C, have the same meanings as those of Table 2 of the embodiment 2.

TABLE 4

| HEAD NO. | ADHESIVE AGENT BASE | | | ACTIVATOR | EVALUATION JETTING TEST | HEAT CYCLE TEST | CRACK | REMARKS |
|---|---|---|---|---|---|---|---|---|
| 1 | EPIKOTE 806 (70) | TGAP (30) | — | HC-100H (80) | NO INK LEAKAGE AFTER 3 WEEKS | A | A | INVENTIVE |
| 2 | EPIKOTE 828 (70) | TGAP (30) | — | HC-100H (80) | NO INK LEAKAGE AFTER 2 WEEKS | A | A | INVENTIVE |
| 3 | EPIKOTE 806 (70) | TGAP (30) | — | HC-120H (80) | NO INK LEAKAGE AFTER 4 WEEKS | A | A | INVENTIVE |
| 4 | EPIKOTE 806 (50) | TGDADPM (50) | — | HC-100H (90) | NO INK LEAKAGE AFTER 2 WEEKS | A | A | INVENTIVE |
| 5 | EPIKOTE 806 (35) | TGAP (30) | EPIKOTE 154 (35) | HC-100H (80) | NO INK LEAKAGE AFTER 5 WEEKS | A | A | INVENTIVE |

TABLE 4-continued

| HEAD | ADHESIVE AGENT | | | | EVALUATION | | | |
|---|---|---|---|---|---|---|---|---|
| NO. | BASE | | | ACTIVATOR | JETTING TEST | HEAT CYCLE TEST | CRACK | REMARKS |
| 6 | EPIKOTE 806 (70) | TGAP (30) | — | TRIETHYLENE-TETRAMINE (9) | ADHESION WAS STILL LEFT AND LEAKAGE OCCURRED IN THE FIRST TEST. | D | — | COMPARATIVE |
| 7 | EPIKOTE 828 (100) | — | — | HC-100H (60) | INK LEAKAGE OCCURRED AFTER 1 WEEK | C | B | COMPARATIVE |
| 8 | EPIKOTE 806 (70) | TGAP (30) | — | MIXTURE OF TRIOXYAN-TRIMETYLENE MERCAPTAN (44) AND TRIBENZYLAMINE (1) | INK LEAKAGE OCCURRED AFTER 1 WEEK | C | A | COMPARATIVE |
| 9 | EPIKOTE 806 (70) | EPIKOTE 154 (30) | — | HC-120H (80) | INK LEAKAGE OCCURRED AFTER 2 WEEK | A | A | INVENTIVE |

In the respective "base" and "activator" of Table 4, types and values in the parentheses have the same meanings as those in Table 1 of the embodiment 1. However, in the "base" of Table 4, "TGAP" means triglycidyl-p-aminophenol, and "TGDADPM" means tetraglycidyl diaminodiphenylmethane.

(4.3) Conclusion

As shown in Table 4, the heads 1 to 5 and 9 show preferable results when compared to those by the heads 6 to 8. In particular, the discharging test and heat cycle test show that members such as the manifold show no cracks, distortions, peelings, or the like, and the observation of cracks shows that the adhesive agent has flexibility. From the above, the adhesive agents having specific compositions like those in the heads 1 to 5 and 9 cure at a low temperature equal to or lower than 60° C., and have flexibility. Furthermore, this result shows that such adhesive agent effectively functions to prevent the member from having cracks, distortions, peelings, or the like.

The entire disclosure of Japanese Patent Application Nos. 2005-79528 filed on Mar. 18, 2005, 2005-79563 filed on Mar. 18, 2005 and 2005-364969 filed on Dec. 19, 2005 including description, claims, drawings and summary respectively are incorporated herein by reference.

What is claimed is:

1. An inkjet head comprising:

a channel substrate having a channel of ink, an adherend member adhered to the channel substrate, and a second adherend member further adhered to the adherend member, wherein the channel substrate is adhered with the adherend member, or the adherend member is adhered with the second adherend member by an adhesive agent comprising a base and an activator, wherein the base comprises at least any one of:

a first epoxy compound of bisphenol F epoxy compound;

a second epoxy compound in which bisphenol F epoxy compound is mixed with an epoxy compound having three or more epoxy groups; and a third epoxy compound in which bisphenol A epoxy compound is mixed with an epoxy compound having three or more epoxy groups, wherein the activator comprises:

polyamide containing a condensation reaction product of C36 unsaturated fatty acid dimer and polyamine, and alicyclic polyamine, the activator containing 5 to 200 parts by mass of the alicyclic polyamine with respect to 100 parts by mass of the polyamide, and wherein the base is mixed with the activator with a ratio of 10 to 200 parts by mass of the activator with respect to 100 parts by mass of the base.

2. The inkjet head of claim 1, wherein the activator contains 10 to 150 parts by mass of the alicyclic polyamine with respect to 100 parts by mass of the polyamide.

3. The inkjet head of claim 1, wherein the activator contains 20 to 100 parts by mass of the alicyclic polyamine with respect to 100 parts by mass of the polyamide.

4. The inkjet head of claim 1, wherein the adhesive agent further comprises fine particles having mean particle size of 0.1 μm or less.

5. The inkjet head of claim 1, wherein at least one of differences in linear thermal expansion coefficient between the channel substrate and the adherend member and between the adherend member and the second adherend member is greater than 12 ppm/K.

6. The inkjet head of claim 1, wherein the ink contains 3 mass % or more of solvent having 9.5 to 15.0 of a SP value and 2.0 to 5.0 of a dipole moment to whole solvent weight.

* * * * *